US009316007B2

(12) United States Patent
Schwörer

(10) Patent No.: US 9,316,007 B2
(45) Date of Patent: Apr. 19, 2016

(54) INDUSTRIAL SCAFFOLDING

(75) Inventor: Artur Schwörer, Senden (DE)

(73) Assignee: PERI GMBH, Weissenhorn (DE)

( * ) Notice: Subject to any disclaimer, the term of this patent is extended or adjusted under 35 U.S.C. 154(b) by 1811 days.

(21) Appl. No.: 11/665,955

(22) PCT Filed: Oct. 11, 2005

(86) PCT No.: PCT/EP2005/010930

§ 371 (c)(1),
(2), (4) Date: Feb. 25, 2008

(87) PCT Pub. No.: WO2006/045432

PCT Pub. Date: May 4, 2006

(65) Prior Publication Data

US 2008/0251323 A1 Oct. 16, 2008

(30) Foreign Application Priority Data

Oct. 22, 2004 (DE) ..... 10 2004 051 614

(51) Int. Cl.
*E04G 1/15* (2006.01)

(52) U.S. Cl.
CPC . *E04G 1/152* (2013.01); *E04G 1/15* (2013.01)

(58) Field of Classification Search
CPC ..... E04G 1/15; E04G 1/152
USPC ..... 182/130, 131, 222, 223
See application file for complete search history.

(56) References Cited

U.S. PATENT DOCUMENTS

| | | | | | |
|---|---|---|---|---|---|
| 2,261,831 | A | * | 11/1941 | Farr et al. | 182/223 |
| 2,335,046 | A | * | 11/1943 | Droeger | 182/119 |
| 2,401,587 | A | * | 6/1946 | Smith | 52/474 |
| 2,851,311 | A | * | 9/1958 | Gibbs | 182/222 |
| 2,981,365 | A | * | 4/1961 | Olsen | 182/223 |
| 3,289,788 | A | * | 12/1966 | Evans et al. | 182/128 |
| 3,565,212 | A | * | 2/1971 | Johnson | 182/222 |
| 4,409,906 | A | * | 10/1983 | Alneng | 514/356 |
| 4,496,029 | A | * | 1/1985 | Kuroda | 182/222 |
| 4,802,553 | A | * | 2/1989 | Waters et al. | 182/222 |
| 4,825,976 | A | * | 5/1989 | Wyse | 182/222 |
| 4,984,654 | A | * | 1/1991 | Anderson | 182/186.7 |
| 5,141,078 | A | * | 8/1992 | Wood | 182/222 |
| 5,603,134 | A | * | 2/1997 | Whipkey et al. | 14/2.4 |
| 5,683,609 | A | * | 11/1997 | Schworer | 249/18 |
| 5,918,700 | A | * | 7/1999 | Gregory | 182/186.8 |
| 6,382,109 | B1 | * | 5/2002 | Novikoff | 108/65 |
| 7,032,712 | B2 | * | 4/2006 | Schworer | 182/178.1 |
| 2002/0166726 | A1 | * | 11/2002 | Schworer | 182/179.1 |

FOREIGN PATENT DOCUMENTS

| | | | |
|---|---|---|---|
| DE | 3245126 | A1 | 6/1984 |
| DE | 19515062 | A1 | 10/1996 |

(Continued)

*Primary Examiner* — Colleen M Chavchavadze

(74) *Attorney, Agent, or Firm* — Kilpatrick Townsend & Stockton LLP

(57) ABSTRACT

The invention relates to industrial scaffolding comprising vertical supports, which can be interconnected by means of horizontal bars. Plates, which extend on a horizontal plane, can be hooked onto the bars to create an accessible working surface. When the plates are fitted, edge areas of the latter overhang the base body of the plates in such a way that a bar running parallel to an edge area is partially covered by said edge area.

13 Claims, 9 Drawing Sheets

(56) References Cited

FOREIGN PATENT DOCUMENTS

| | | | |
|---|---|---|---|
| EP | 1389660 | A1 | 2/2004 |
| GB | 945 822 | A | 1/1964 |
| GB | 2 338 260 | A | 12/1999 |
| GB | 2 362 421 | A | 11/2001 |
| GB | 2 362 422 | A | 11/2001 |
| GB | 2382100 | A | 5/2003 |

* cited by examiner

INDUSTRIAL SCAFFOLDING

CROSS-REFERENCE TO RELATED APPLICATIONS

This application is a National Stage of International Application No. PCT/EP2005/010930, filed Oct. 11, 2005, and which claims the benefit of German Patent Application No. 10 2004 051 614.6, filed Oct. 22, 2004. The disclosures of the above applications are incorporated herein by reference.

FIELD

The invention relates to industrial scaffolding comprising vertical supports which can be connected to one another by means of horizontally extending bars, with decking units extending in a horizontal plane being able to be hung into the bars to create a working surface which can be walked on.

BACKGROUND

The statements in this section merely provide background information related to the present disclosure and may not constitute prior art.

Industrial scaffolding of this type is used in many cases in practice to service or erect industrial plants, in particular chemical plants. Industrial scaffolding is also used in ship building or in the servicing of ships. In a number of these applications, the problem occurs that complex contours have to be scaffolded which only have a few straight surfaces. It is in particular often also necessary to build around pipes or piping plants, which is particularly difficult when—as is generally desired—the working surface of the scaffolding should be guided as close as possible to the surfaces to be built around.

Industrial scaffolding known from the prior art only satisfies these demands in that a plurality of different scaffold parts are kept in stock which are adapted to the most varied shapes, which means a disadvantageously high cost and/or effort.

Furthermore, there is the requirement in industrial scaffolding erection to create working surfaces which are at least largely free of gaps so that e.g. small parts which are dropped on the carrying out of work cannot fall through the working surface. Since, however, there are often gaps between decking units adjacent to one another in known industrial scaffolding, it is necessary to cover them with separate additional elements, which in turn induces a disadvantageous effort and/or cost.

GB-A-2362422 discloses a scaffolding system in which decking units can be hung into bars or carriers. Projecting marginal regions provided only at the end faces at the decking unit elements cover a part region of the bar.

GB 945 822 A shows a scaffolding system in which bars are provided which have grooves configured as multiple folds and into which decking units likewise provided with folds can be hung.

SUMMARY OF THE INVENTION

It is an object of the present invention to provide industrial scaffolding of the initially named kind by means of which work surfaces free of gaps to the largest extent possible can be provided while stocking the lowest possible number of different parts.

It is the surprisingly simple idea underlying the invention to modify specific marginal regions of the decking units such that they cover a bar, optionally extending parallel to such a marginal region, at least regionally, which has the result that no problematic gap can arise between the decking unit and the bar. If, furthermore, decking units are arranged at both sides of a bar which extend in parallel to one another and whose marginal regions facing the bar are configured in accordance with the invention, it is achieved that these marginal regions almost mutually contact one another or only form a very small gap between them. In this manner, a practically throughgoing working surface is also provided in the region of the bar without any gap or step, with the bar covered by the marginal regions configured in accordance with the invention being practically no longer visible when viewed from above. A correspondingly throughgoing working surface without any gap is also ensured in accordance with the invention when no bar is located between the adjacent decking units since the projecting marginal regions of the decking units are almost adjacent to one another independently of the presence of a bar.

The base member of the decking units in accordance with the invention extend as a rule in the same plane as the bars, with the projecting marginal regions being arranged just above this plane so that no collisions can occur between these marginal regions and the bars. The base members of the decking units are measured such that they can be introduced between the bars without abutting the bars.

All this is achieved in accordance with the invention without any additional elements having to be provided which would be suitable to cover gaps between decking units. Gaps of this type are completely avoided by the invention only by the specific configuration of the decking units or their marginal regions.

Since no additional cover elements are required, the number of the different parts required for the industrial scaffolding is greatly reduced, which minimizes the stocking effort and the logistics associated therewith, which simplifies the planning of industrial scaffolding and which facilitates the assembly or disassembly.

The decking units in accordance with the invention can have a rectangular shape and have hook members at their end faces for hanging in a bar so that these hook members and any further support elements provided at the end faces at the decking units are substantially responsible for the force transmission from the decking units to the bars. The end faces of the decking units in this case, unlike their longitudinal sides, have no projecting marginal regions or have marginal regions which only project very slightly since the decking units must always adjoin a bar at the end face due to their construction so that no gaps can occur between decking units adjacent to one another at the end faces. Gaps of this type are rather filled by the necessarily present bars.

The longitudinal sides of the decking units, in contrast, are provided with marginal regions projecting in accordance with the invention. This advantageously has the result that decking units adjacent to one another at the longitudinal sides do not form any real gaps between them and indeed independently of whether a bar is present between the decking units or not. The projecting marginal regions are rather largely directly adjacent to one another and thus form a throughgoing surface, with them either covering a bar present between the decking units or—if such a bar is lacking—covering the hollow space provided for such a bar.

Base bars extending between two vertical supports and additional bars extending between base bars and/or vertical supports are preferably provided. Furthermore, additional bars can also be provided which extend in turn between additional bars, base bars and/or vertical supports. Base bars are thus always arranged between two vertical supports, whereas end-face coupling regions of additional bars can be coupled in any desired manner to vertical supports, base bars or further additional bars. The additional bars extend perpendicular to those bars to which they are fastened, with all bars of a working level being located in one and the same plane.

It is made possible by the provision of the mentioned additional bars to adapt the industrial scaffolding in accordance with the invention to the most varied contours and in particular also to provide comparatively small cut-outs in the working surfaces to be created without a plurality of different parts being necessary for this. The provision of the mentioned additional bars in particular makes it possible in this connection that a plurality of first decking units can be present in a working surface which can be walked on, the decking units being aligned parallel to one another, with furthermore two decking units being present which extend perpendicular to the first decking units. Corresponding examples will be explained in the following within the framework of the description of the Figures.

It is particularly advantageous for the base bars and the additional bars to have identical cross-sections and also to have identical end-face coupling sections. The production effort is thereby minimized and it additionally becomes possible to use the present bars in a versatile manner both as base bars and as additional bars since there are practically no differences between the base bars and the additional bars. The only relevant differences are present in the length of the bars, with individual cases, however, actually being conceivable in which the base bars and the additional bars have the same lengths among one another.

Since the bars in accordance with the invention, which can be used either as base bars or as additional bars, must be able to be coupled either as base bars to vertical supports or also as additional bars to further bars, it is sensible to form the end-face coupling sections of the bars such that they are, for example, suitable for fastening to rosettes connected to the vertical supports, with separate coupling elements then having to be provided for the fastening of an additional bar to a further bar which are suitable to connect a bar to an end-face coupling section of an additional bar. Coupling elements of this type can then be attached to any desired points along a bar.

The decking units in accordance with the invention are preferably available in different sizes adapted to a grid dimension, with the spacing of the longitudinal axes of adjacent vertical supports amounting to a whole-number multiple of the grid dimension. The grid dimension can, for example, have a length of 25 cm or any other desired lengths. Accordingly, in this case, the bars which can be used as base bars and as additional bars are also present in sizes matched to the grid dimension so that the total system can be used with the highest possible degree of versatility with a minimal number of parts having to be stocked.

The longitudinal extent of the decking units, including the end-face hook members for the hanging into a bar, can amount to a little more than a whole-figure multiple of the grid dimension so that the hook members can engage completely over the bars. Such a gripping over effectively prevents a relative movement of the decking units perpendicular to those bars at which the decking units are hung in. If the longitudinal extent of the decking units, including the end-face hook members, were only to amount to a whole-number multiple of the grid dimension, only a placing on of the bars would be possible, but not a hanging in, so that then the mentioned relative movement would not be prevented in a disadvantageous manner.

If a multiple of the grid dimension is spoken of within the framework of the invention, this multiple also includes the simple grid dimension.

The longitudinal extent of the decking units without the end-face hook members preferably amounts to somewhat less than a whole-number multiple of the grid dimension so that a hanging in of two decking units adjacent at the end faces is possible in a common bar without an already hung in decking unit preventing the hanging in of a further decking unit.

The width of the decking units in accordance with the invention including the projecting marginal regions can be equal to once, twice or three times the grid dimension. It is achieved by these dimensions that decking units adjoining one another at the longitudinal sides practically do not form any gap between them. In this case, cut-outs for wedges with which the bars can be fastened to the vertical supports can preferably be present in the projecting marginal regions. Cut-outs of this type are sensibly only provided in those sections of the marginal regions which are located in direct proximity to the vertical supports and thus to the wedges.

Alternatively, the width of the decking units, including the projecting marginal regions, can also amount to less than once, twice or three times the grid dimension so that the wedges find room between two decking units adjacent to one another at the longitudinal sides. In this case, a slight gap between mutually adjacent decking units is accepted.

Finally, it is sensible to equip the decking units at the end faces with a security against lifting such as is already known from the prior art.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DESCRIPTION OF THE PREFERRED EMBODIMENTS

Figure 1:
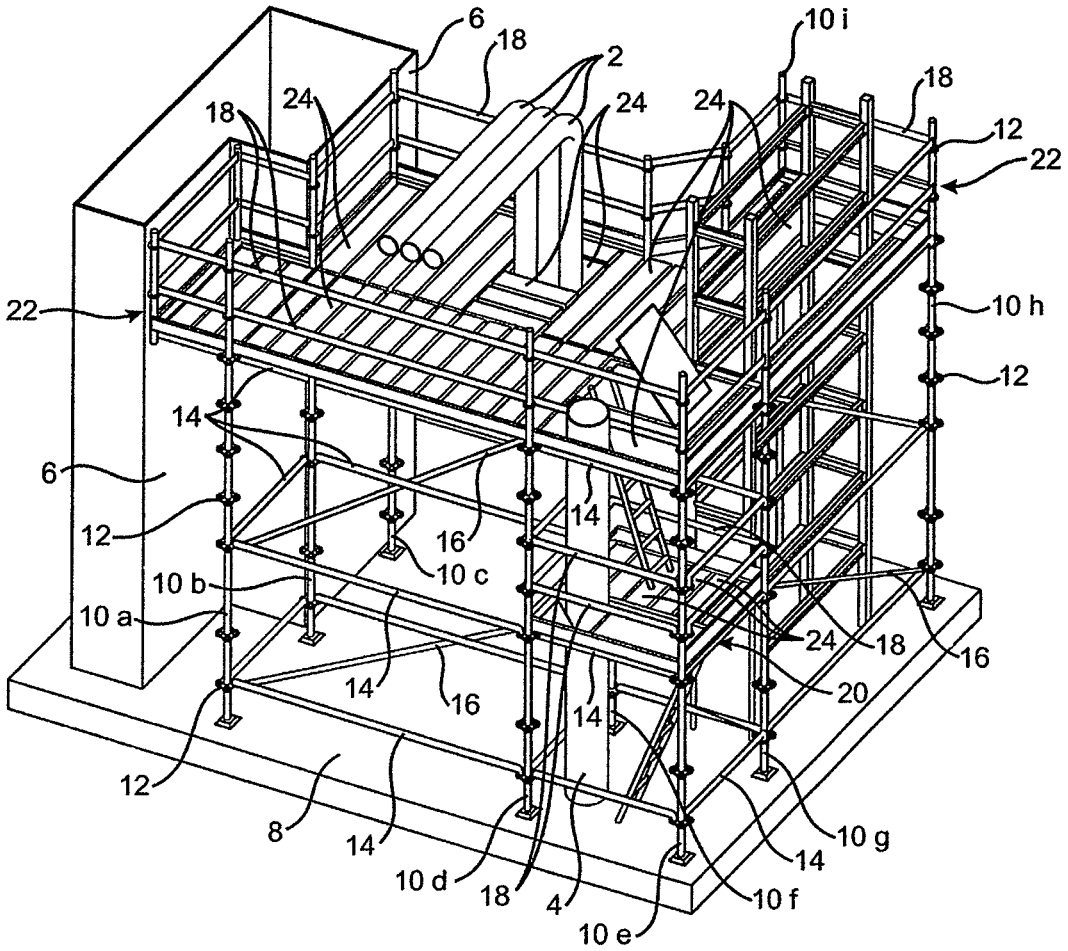
FIG. 1 is a three-dimensional representation of industrial scaffolding in accordance with the invention matched to a specific application.

The following description is merely exemplary in nature and is not intended to limit the present disclosure, application, or uses. It should be understood that throughout the drawings, corresponding reference numerals indicate like or corresponding parts and features.

FIG. 1 shows an industrial plant which has pipes 2, 4 and walls 6 and which is scaffolded by industrial scaffolding in accordance with the invention to be able to carry out service work in the region of the pipes 2, 4 and of the walls 6 in a plane which is spaced approximately 4 m from the floor 8. The scaffolding comprises a plurality of vertical supports 10*a* to *k* which comprise, in the application shown, a plurality of parts plugged into one another such as are known from the prior art. The vertical supports 10*a* to *k* are provided with rosettes 12 which are spaced apart from one another equidistantly and into which bars 14 can be hung, among other things, which connect adjacent vertical supports 10*a* to *k* with one another.

Furthermore, diagonal supports 16 are provided in a known manner for the stabilization of the scaffolding which can likewise be hung into the rosettes 12. Furthermore, railing members 18 can also be hung into the rosettes 12 to secure working levels.

In the embodiment shown, a comparatively small lower working level 20, which is only made in rectangular form, and a larger upper working level 22 of more complex design are provided. Both working levels are each formed by a plurality of decking units 24, with the lower working level 20 only comprising six decking units 24 extending next to one another in parallel. The upper working level 22, in contrast, comprises a larger number of decking units 24 which have three different lengths, but mutually the same widths, with some of these decking units 24 being oriented parallel to one another and others of these decking units 24 being oriented perpendicular to one another.

All the decking units 24 of the two working levels 20, 22 are hung into the bars 14, which will be explained in even more detail in the following in connection with FIG. 4.

FIG. 1 illustrates that industrial scaffolding in accordance with the invention can be matched very individually and precisely to the respective shapes of the pipes 2, 4 and of the walls 6 to be built around without real gaps occurring here, for example, between the decking units 24 and the pipes 2. Furthermore, the decking units 24 are configured such that likewise no gaps can occur between them, which will be explained in the following in connection with FIGS. 2 and 3.

Figure 2:
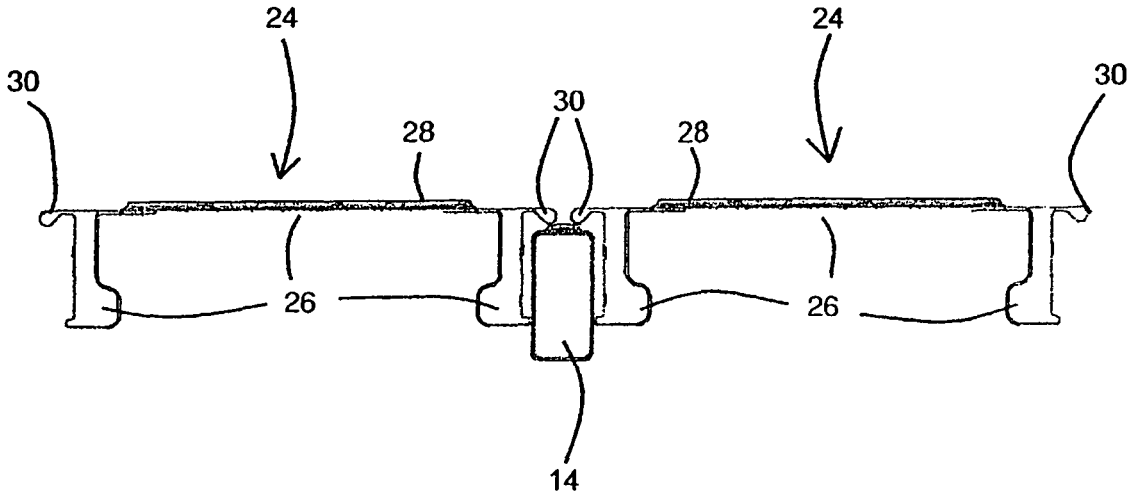
FIG. 2 is a section through two decking units in accordance with the invention with a bar arranged between them.

FIG. 2 shows two decking units 24 in section which extend in parallel to one another and between which a bar 14 is arranged whose longitudinal extent extends parallel to the longitudinal sides of the decking units 24. The decking units 24 each comprise a base body 26 which has a comparatively thin, horizontally extending level which can be walked on and from where stiffening elements stable in the outer regions extend substantially perpendicularly downwardly. These stiffening elements are arranged only at the longitudinal sides of the decking units 24 and not at their end faces. When the scaffolding is erect, the stiffening elements are substantially in the same plane as the bars 14, which means that the scaffold parts have to be dimensioned such that the stiffening elements and the bars 14 do not collide with one another on the assembly or disassembly of the scaffolding.

Figure 6:
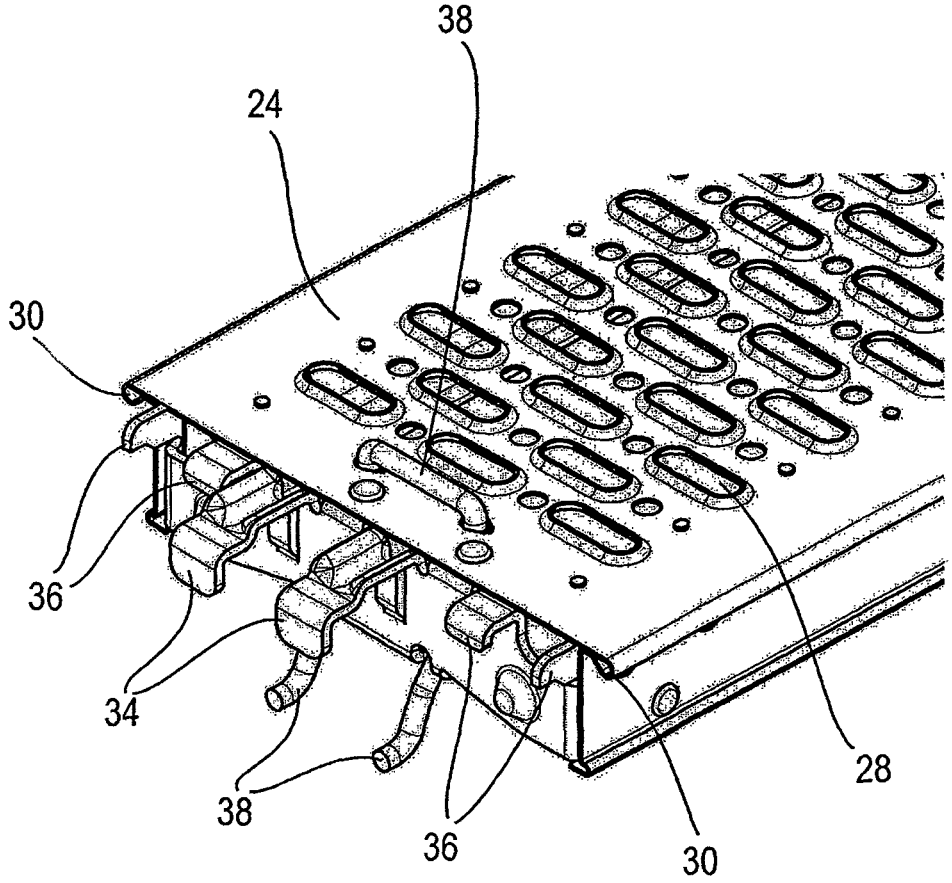
FIG. 6 is a three-dimensional view of the end region of a decking unit in accordance with the invention.

The horizontally extending plane of the base body 26 has openings 28 for reasons of material and weight savings which simultaneously serve as anti-slip members and whose shape can be seen better from FIG. 6, for example.

The longitudinal sides of the decking units 24 are each provided with projecting marginal regions 30 which project laterally beyond the base body 26 and are located above that plane in which the bars 14 extend when the scaffolding is erected. It is achieved in this manner that two mutually facing, projecting marginal regions 30 of two adjacent bars 24 largely cover a bar 14 so that only a slight gap is formed between the two projecting marginal regions 30.

To prevent small parts which have been dropped from being able to fall through the working level of a scaffold in accordance with the invention, it would basically be sufficient for the marginal regions of the decking units 24 to be guided sufficiently close to the bar 14 in accordance with FIG. 2. It must, however, be taken into account that, in a specific scaffolding application, it occurs more frequently that no bar 14 is present between decking units 24 extending parallel to one another, which would then result in problematic gaps between the decking units 24.

Figure 3:
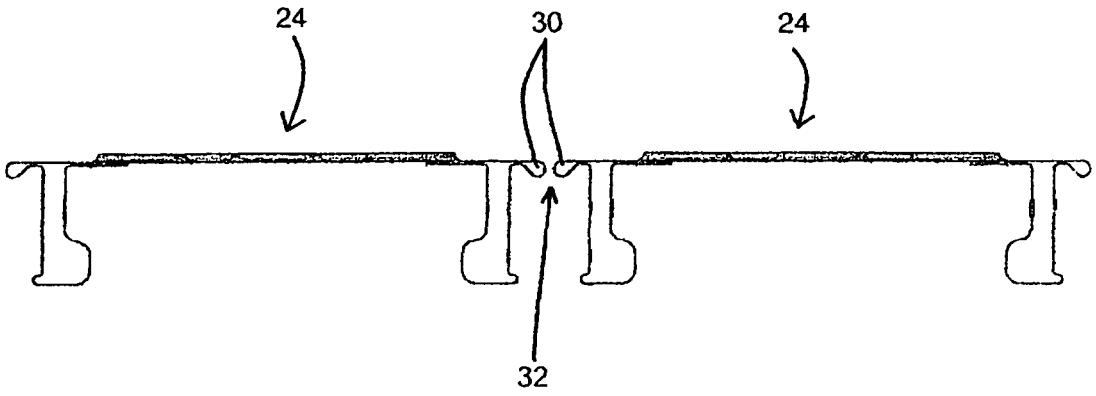
FIG. 3 is a section through two decking units in accordance with the invention without a bar arranged between them.

The provision in accordance with the invention of projecting marginal regions 30, however, makes it possible in accordance with FIG. 3, also in the case of no bar being present, to form working surfaces without problematic gaps between mutually adjacent decking units since the projecting marginal regions 30 of adjacent decking units are guided sufficiently closely to one another. The gap 32 visible from FIG. 3 between the projecting marginal regions 30 is so small in practice that it ultimately does not form any problematic gap.

Figure 4:
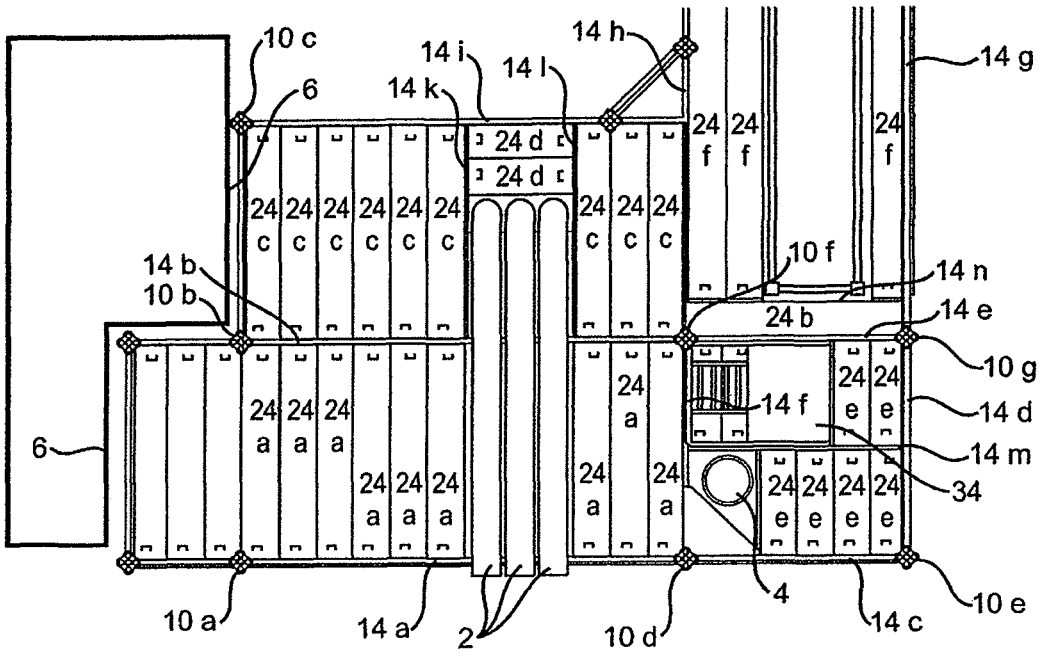
FIG. 4 is a plan view of the working surface of the scaffold in accordance with FIG. 1.

FIG. 4 shows a plan view of the upper working level 22 in accordance with FIG. 1.

A bar 14*a, b* is fastened in each case between the vertical supports 10*a* and 10*d* as well as between the vertical supports 10*b* and 10*f* so that decking units 24*a* which fill the space between the bars 14*a* and 14*b* can be hung into the bars 14*a, b*. The bars 14*a* and 14*b* thus form base bars in the sense of the invention connecting vertical supports 10*a* and 10*d* as well as 10*b* and 10*f*.

The following further base bars are formed between the following further vertical supports:

Base bar 14*c* between vertical supports 10*d* and 10*e*
Base bar 14*d* between vertical supports 10*e* and 10*g*
Base bar 14*e* between vertical supports 10*g* and 10*f*
Base bar 14*f* between vertical supports 10*d* and 10*f*
Base bar 14*g* between vertical supports 10*g* and 10*h*
Base bar 14*h* between vertical supports 10*f* and 10*i*

The vertical supports 10*h* and 10*i* are not shown in FIG. 4, but can be seen from FIG. 1.

In addition to the decking units 24*a*, only the decking unit 24*b* is still hung in between two base bars, namely between the base bars 14*g* and 14*h*. All other decking units are located between a base bar and an additional bar, which will still be explained in the following.

An additional bar 14*i* is arranged between the vertical support 10*c* and the base bar 14*h* such that it extends parallel to the base bar 14*b*. Boards 24*c* can thus be hung in between the base bar 14*b* and the additional bar 14*i* which have the same dimensions as the decking units 24*a* and 24*b*.

To permit an optimum building around of the pipes 2, two additional bars 14*k* and 14*l* are furthermore provided which extend parallel to one another between the additional bar 14*i* and the base bar 14*b*. These additional bars 14*k*, 14*l* are provided as close as possible to the pipes 2 and are spaced apart from one another such that smaller decking units 24*d* can be hung into the additional bars 14*k*, 14*l*. Two decking units 24*d* are arranged on the side of the pipes 2 facing the additional bar 14*i*; three further decking units 24*d* are on the side of the pipes 2 remote from the additional bar 14*i*.

A further additional bar 14*m* extends parallel to the base bar 14*c* between the two base bars 14*f* and 14*d*, with the additional bar 14*m* being located centrally between the two base bars 14*e* and 14*c*. Boards 24*e* can thus be hung between base bar 14*e* and additional bar 14*e*, on the one hand, and between additional bar 14*m* and base bar 14*c*, on the other hand, such that both the pipe 4 and a passage 34 can be built around ideally in an L shape.

A further additional bar 14*n* extends parallel to that longitudinal side of the decking unit 24*b* remote from the base bar 14*e*. Boards 24*f* whose lengths amount to approximately twice that of the decking units 24*c* can thus be hung in this manner between this additional bar 14*n* and a base bar formed between the vertical supports 10*h* and 10*i* visible from FIG. 1.

FIG. 4 thus illustrates that a grid can be provided by a skillful combination of base bars 14*a* to *h* and additional bars 14*i* to *n* which can be adapted to individual circumstances and into which decking units 24*a* to *f* of different sizes can then be hung such that the working level 22 can be guided as closely as possible to the contours to be built around. In the example in accordance with FIG. 4, an additional bar 14*i* is used which extends between a vertical support 10*c* and a base bar 14*h*. Furthermore, additional bars 14*k, m* and *n* are shown which extend between two base bars. Finally, an additional bar 14*l* is also used which extends between a base bar and an additional bar.

Figure 5:
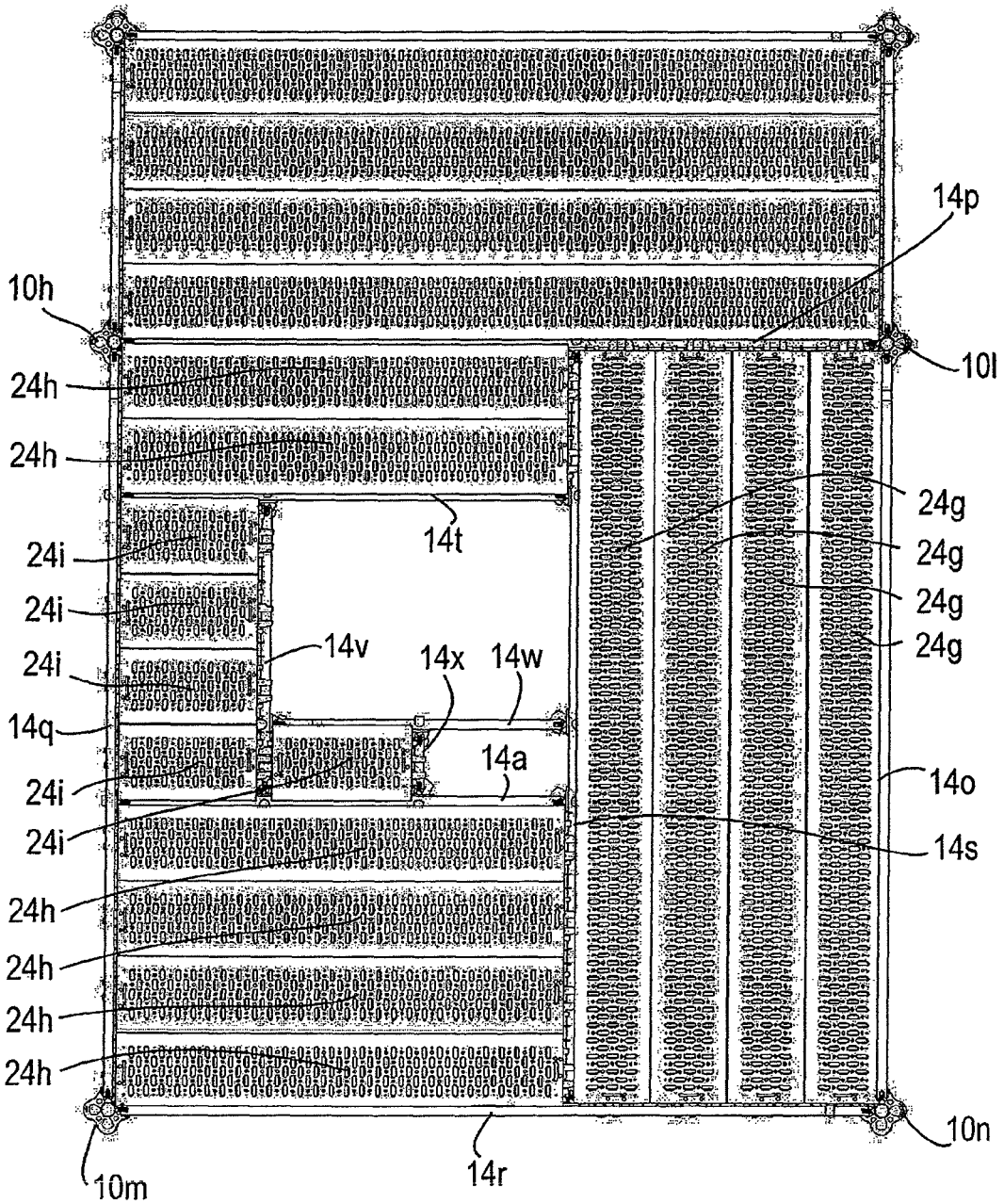
FIG. 5 is a plan view of a further working surface designed in accordance with the invention.

FIG. 5 now illustrates that additional bars are also possible which in turn extend only between additional bars:

Base bars 14*o* to 14*r* are arranged between four vertical supports 10*k* to 10*m* spanning a square such that they together likewise describe the shape of a square. A total of four long decking units 24*g* are hung between the base bars 14*p* and 14*r*. The region covered by the decking units 24*g* is bounded by an additional bar 14*s* which has the same length as the decking units 24*g* and which is located between the base bars 14*p* and 14*r*. Boards of medium length 24*h* are hung between this additional bar 14*s* and the base bar 14*q*.

The two regions covered by the decking units 24*h* are each in turn bounded by an additional bar 14*t* or 14*u* respectively which are each located between the base bar 14*q* and the additional bar 14*s*. A further additional bar 14*v* is hung between the two additional bars 14*t* and 14*u* and extends perpendicular to the two additional bars 14*t* and 14*u*. A further additional bar 14*w*, which extends parallel to the additional bar 14*u*, is hung between the additional bars 14*v* and 14*s*. Finally, a last additional bar 14*x* is located between the additional bars 14*u* and 14*w*. This additional bar 14*x* extends parallel to the base bar 14*q*.

In this manner, a grid is created by the additional bars 14*t* to *x* in which small decking units 24*i* can be hung which together cover an L-shaped area.

FIG. 6 shows the end region of a cover 24 with the already mentioned openings 28 as well as with two end-face hook members 34 which are suitable to engage over a bar 14. Furthermore, a total of four support elements 36 are provided at the end face at the decking unit 24 and are arranged such that they can ultimately be supported on that bar 14 which is engaged over by the hook members 34.

Finally, the decking unit 24 is also equipped with a security against lifting 38 which is displaceable in cut-outs provided therefor and which is formed by a steel hoop which can be moved beneath a bar 14 such that the bar 14 is ultimately fixed between the hook members 34 and the security against lifting 38.

The projecting marginal regions 30 provided in accordance with the invention which were already explained in connection with FIGS. 2 and 3 can also be recognized easily in FIG. 6.

Figure 7:
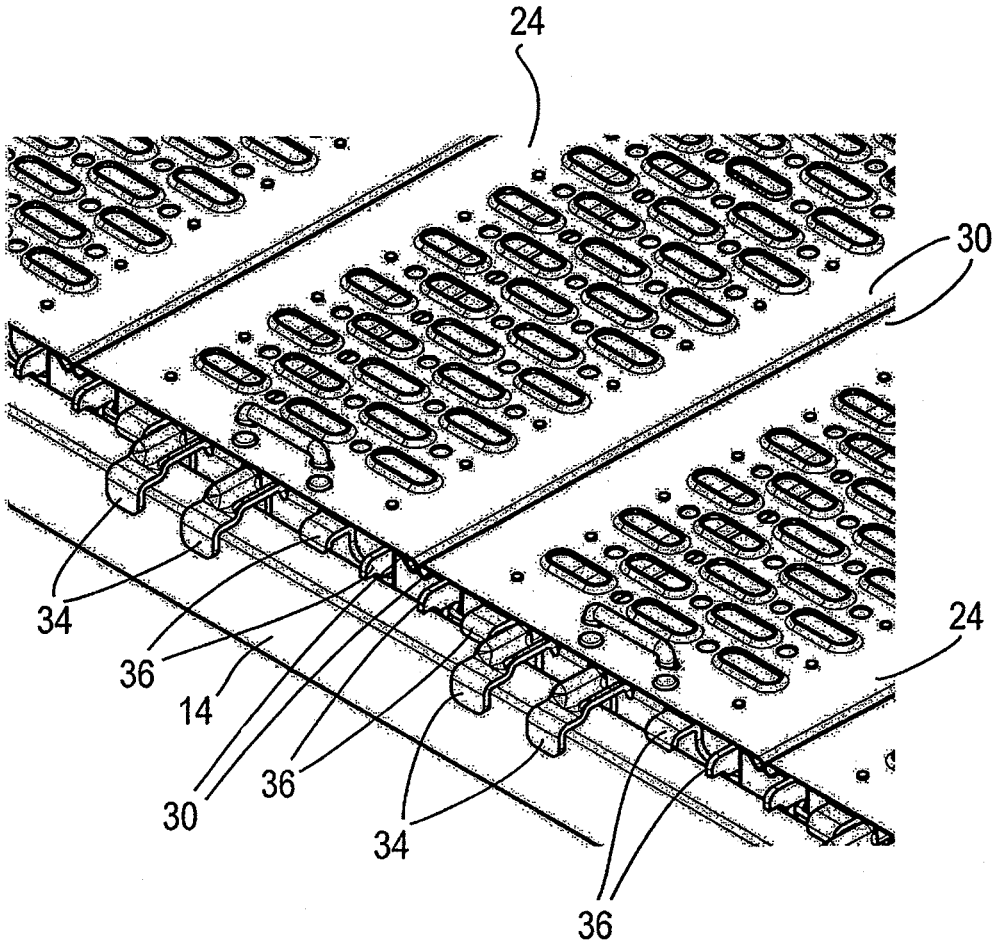
FIG. 7 is a three-dimensional view of a plurality of decking units in accordance with FIG. 6 which extend parallel to one another and which are hung into a bar.

FIG. 7 shows how decking units 24 in accordance with FIG. 6 can be hung into a bar 14. In accordance with FIG. 7, two decking units 24 extend parallel to one another so that their hook members 34 engage over a common bar 14 from the same side, with the support elements 36 of both decking units 24 also being supported on this bar 14.

Due to the projecting marginal regions 30, the two decking units 24 are located in direct proximity to one another without a problematic gap being formed between them. This would apply in the same manner if a further bar 14 were present beneath the region at which the two marginal regions 30 are adjacent to one another.

Figure 8:
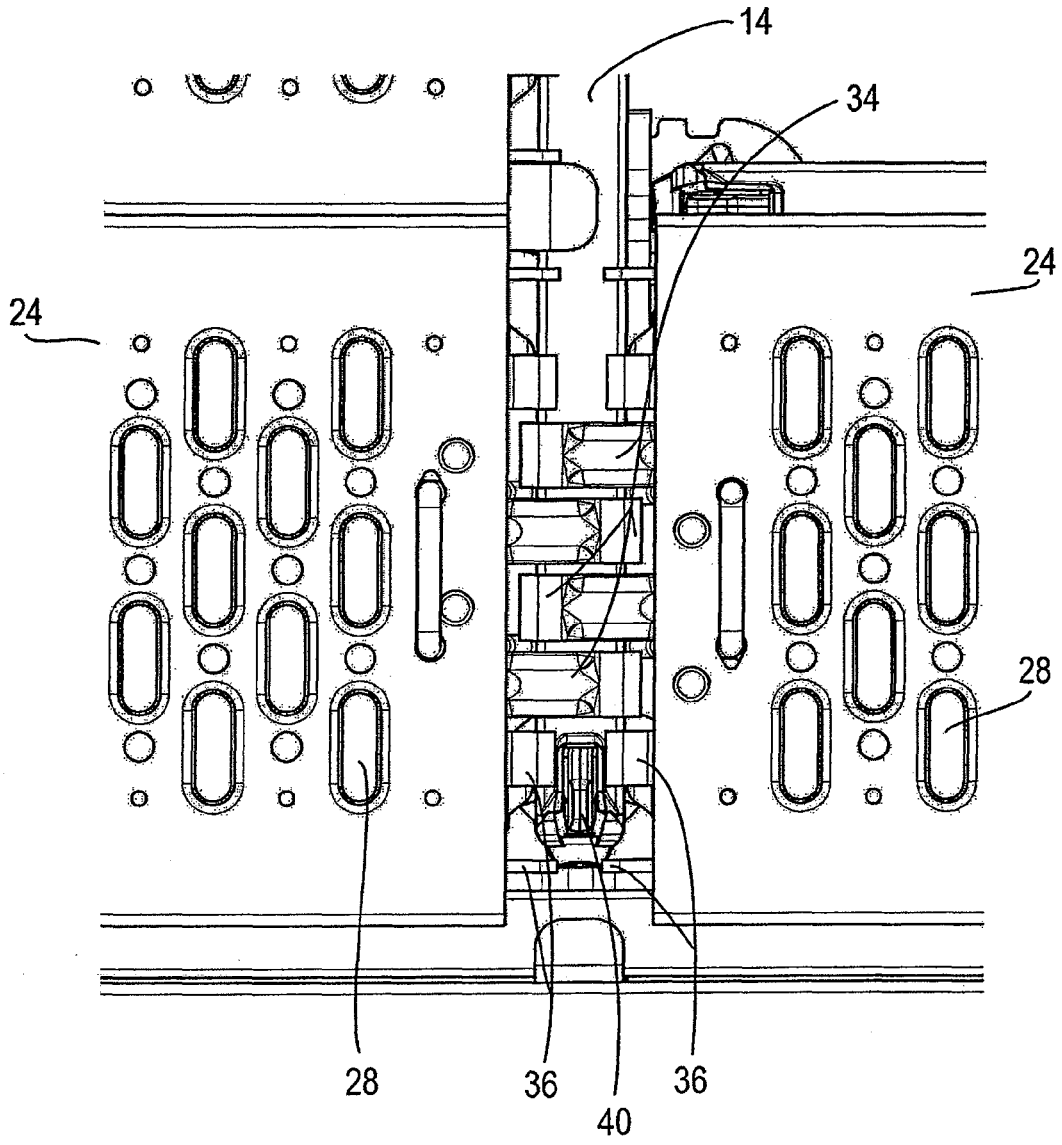
FIG. 8 is a plan view of two decking units in accordance with the invention in accordance with FIG. 6 which are mutually adjacent and which are hung into a common bar.

FIG. 8 shows two decking units in accordance with FIG. 6 which are adjacent to one another and which are hung into a common bar 14 from opposite sides. Since the hook members 34 are not arranged centrally to the end faces of the decking units 24, but somewhat offset to the center, the two decking units can be aligned in a longitudinal direction with one another without their hook members 34 engaging over the common bar 14 abutting one another. The intermediate spaces formed between the decking unit elements 24 and the bar 14 have approximately the same magnitude as the openings 28 of the decking unit elements so that these intermediate spaces are ultimately not disturbing. The support elements 36 of the decking units 24 are dimensioned to be so short that they do not collide with one another with decking units 24 adjoining one another at the end faces, but rather leave space between them for any fastening elements 40 which may be required, by means of which bars 14 can be fastened to further bars 14 or to rosettes 12.

Figure 9:
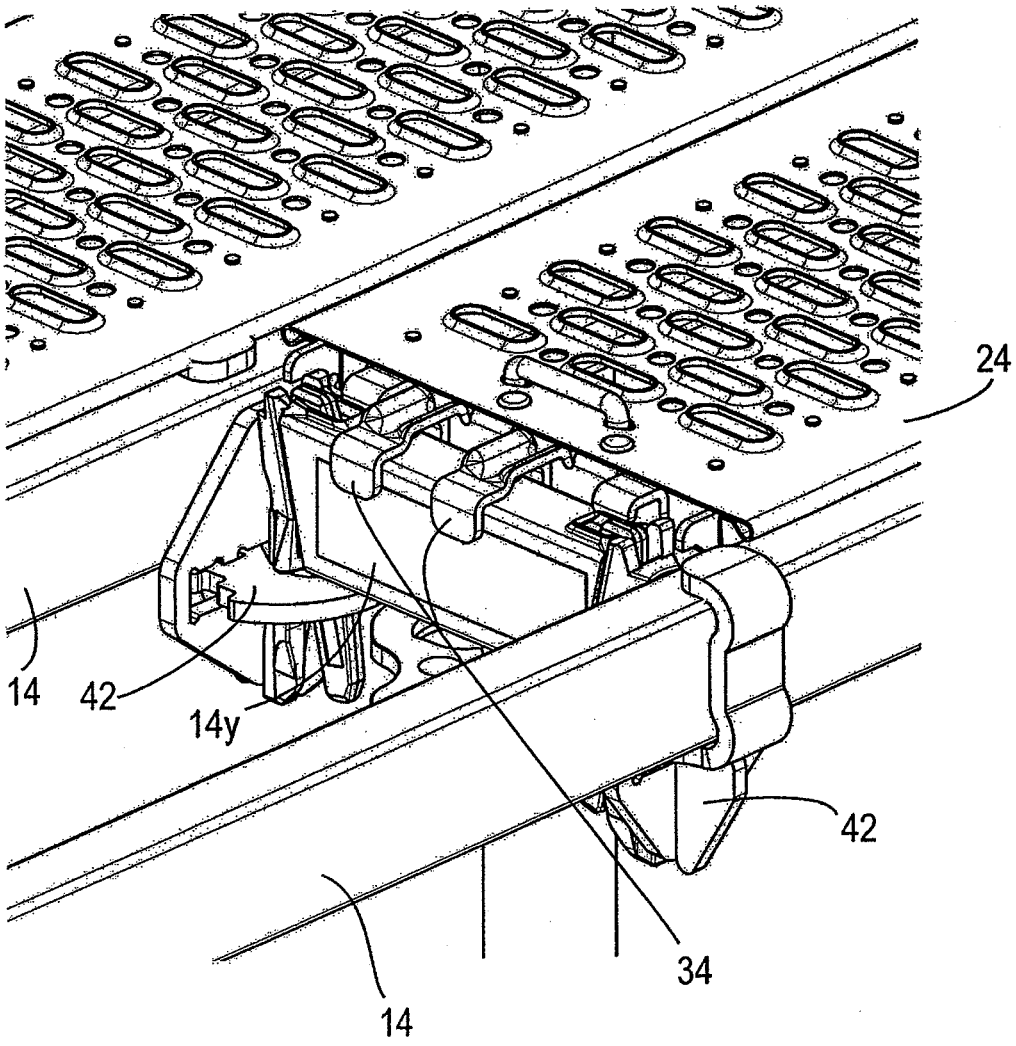
FIG. 9 is a three-dimensional view of the end region of a decking unit in accordance with the invention in accordance with FIG. 6 which is hung into an additional bar.

FIG. 9 shows in a perspective representation a short additional bar 14*y* which is fastened between two bars 14 and which is engaged over by hook members 34 of a decking unit 24.

Special coupling members 42 are provided for the fastening of the additional bolt 14*y* which engage in clamping fashion around the bars 14 extending in parallel to one another and can be displaced along the bar 14 to any desired position required in each case. The coupling elements 42 then have suitable fastening positions for the additional bar 14*y* to which it can be fixed and secured.

The description is merely exemplary in nature and, thus, variations that do not depart from the gist of the present disclosure are intended to be within the scope of the invention. Such variations are not to be regarded as a departure from the spirit and scope of the present disclosure.

REFERENCE NUMBER LIST

2 pipes
4 pipe
6 walls
8 base
10*a*-10*n* vertical supports
12 rosettes
14*a*-14*y* bars
16 diagonal supports
18 railing elements
20 working level
22 working level
24*a*-24*i* decking units
26 base body
28 opening
30 projecting marginal region
32 gap
34 hook members
36 support elements
38 security against lifting
40 fastening elements
42 coupling element

The invention claimed is:

1. Industrial scaffolding, comprising:

vertical supports connected to one another with horizontally extending bars; and a plurality of decking units which can be walked on arranged in a horizontal plane and which are hung from the bars, each decking unit including hook members at lateral ends of the decking unit for hanging the decking unit from the bars, a base body arranged below and providing support for the decking unit, and marginal regions extending over substantially an entire length of the decking unit and extending laterally past the base body and over a portion of the bars adjacent the longitudinal sides of the decking unit to form a gap between the longitudinal sides of adjacent decking units which is smaller than a width of the bars between the longitudinal sides in a direction transverse to the longitudinal sides.

2. Industrial scaffolding in accordance with claim 1, wherein the horizontally extending bars comprise horizontal base bars extending between vertical supports, and additional horizontal bars extending between the base bars, the vertical supports and at least one of the additional bars.

3. Industrial scaffolding in accordance with claim 2, wherein the base bars and the additional bars extend in the same plane.

4. Industrial scaffolding in accordance with claim 1, wherein a plurality of first decking units are present in a working surface, which can be walked on and are aligned parallel to one another, and wherein two decking units are present which are aligned perpendicular to the first decking units.

5. Industrial scaffolding in accordance with claim 2, wherein the base bars and additional bars have identical cross-sections and have identical coupling sections at the end faces.

6. Industrial scaffolding in accordance with claim 2, wherein the base bars and the additional bars are connected to one another via separate coupling elements.

7. Industrial scaffolding in accordance with claim 1, wherein the decking units are present in different sizes matched to a grid dimension, with the spacing of the longitudinal axes of adjacent vertical supports amounting to a whole-number multiple of the grid dimension.

8. Industrial scaffolding in accordance with claim 7, wherein the longitudinal extent of the decking units, including end-face hook members, amounts to a little more than a whole-number multiple of the grid dimension so that an engaging over of the bars by the hook members is possible.

9. Industrial scaffolding in accordance with claim 7, wherein the longitudinal extent of the decking units, without end-face hook members, amounts to somewhat less than a whole-figure multiple of the grid dimension so that a hanging of two end-face adjacent decking units in a common bar is possible.

10. Industrial scaffolding in accordance with claim 7, wherein the width of the decking units, including the marginal regions, is equal to one of 1×, 2× and 3× the grid dimension.

11. Industrial scaffolding in accordance with claim 7, wherein the width of the decking units, including the projecting marginal regions, amounts to somewhat less than one of 1×, 2× and 3× the grid dimension.

12. Industrial scaffolding in accordance with claim 1, wherein the decking units include a security member preventing a lifting of the decking units at their end faces.

13. Industrial scaffolding according to claim 1 wherein opposing marginal regions of adjacent decking units are located directly above a bar beneath and in close proximity to each other.

* * * * *